US010279609B2

(12) United States Patent
Xiao

(10) Patent No.: US 10,279,609 B2
(45) Date of Patent: May 7, 2019

(54) INK-JET PRINTHEAD, INK-JET PRINTING DEVICE AND DISPLAY MANUFACTURING DEVICE

(71) Applicants: Boe Technology Group Co., Ltd., Beijing (CN); Ordos Yuansheng Optoelectronics Technology Co., Ltd., Inner Mongolia (CN)

(72) Inventor: Ang Xiao, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 9 days.

(21) Appl. No.: 15/517,279

(22) PCT Filed: Jun. 20, 2016

(86) PCT No.: PCT/CN2016/086414
§ 371 (c)(1),
(2) Date: Apr. 6, 2017

(87) PCT Pub. No.: WO2017/166450
PCT Pub. Date: Oct. 5, 2017

(65) Prior Publication Data

US 2018/0178568 A1 Jun. 28, 2018

(30) Foreign Application Priority Data

Mar. 31, 2016 (CN) ..... 2016 2 0262860 U

(51) Int. Cl.
*B41J 29/17* (2006.01)
*B41J 2/14* (2006.01)
*B41J 2/17* (2006.01)

(52) U.S. Cl.
CPC ..... *B41J 29/17* (2013.01); *B41J 2/1433* (2013.01); *B41J 2/1714* (2013.01); *B41P 2235/10* (2013.01); *B41P 2235/27* (2013.01)

(58) Field of Classification Search
CPC . B41J 2/162; B41J 2/1433; B41J 29/17; B41J 2/1714
(Continued)

(56) References Cited

U.S. PATENT DOCUMENTS 5,298,926 A * 3/1994 Fukushima ..... B41J 2/02 347/105
2008/0018707 A1 1/2008 Masuyama et al.
2011/0109693 A1* 5/2011 Ohnishi ..... B41J 2/18 347/34

FOREIGN PATENT DOCUMENTS

CN 102066116 5/2011
EP 473179 3/1992
(Continued)

OTHER PUBLICATIONS

International Search Report and Written Opinion from PCT/CN16/86414 dated Dec. 28, 2016.

*Primary Examiner* — Jannelle M Lebron
(74) *Attorney, Agent, or Firm* — Calfee, Halter & Griswold LLP

(57) ABSTRACT

An ink jet printhead, an ink-jet printing device and a display manufacturing device are provided for eliminating or reducing droplets on areas outside of the printing area during the ink-jet printing process, thereby improving product quality. The ink jet printhead provided in the disclosure comprises at least one nozzle and a droplet removing component disposed in at least one edge area around the area where the at least one nozzle is located, the droplet removing component
(Continued)

being used for eliminating or reducing droplets at positions corresponding to the edge area where the droplet removing component is located.

18 Claims, 5 Drawing Sheets

(58) Field of Classification Search
USPC ..... 347/40, 44, 47, 84, 85, 92
See application file for complete search history.

(56) References Cited

FOREIGN PATENT DOCUMENTS

| | | |
|---|---|---|
| JP | H0483645 | 3/1992 |
| JP | 2010188562 | 9/2010 |

* cited by examiner

INK-JET PRINTHEAD, INK-JET PRINTING DEVICE AND DISPLAY MANUFACTURING DEVICE

RELATED APPLICATIONS

The present application is the U.S. national phase entry of PCT/CN2016/086414, with an international filling date of Jun. 20, 2016, which claims the benefit of Chinese Patent Application No. 201620262860.7, filed on Mar. 31, 2016, the entire disclosure of which is incorporated herein by reference.

TECHNICAL FIELD

The present disclosure relates to the technical field of display, in particular to an ink-jet printhead, an ink-jet printing device and a display manufacturing device.

BACKGROUND

In order to further increase material utilization rate and reduce complexity of manufacturing process, the ink jet printing technology has been applied to the manufacturing process for flat panel display at present. For example, the ink-jet printing technology can be applied to the flexible OLED (Organic Light Emitting Diode) film packaging process for uniformly depositing an organic material on an OLED light-emitting device by means of ink-jetting.

The basic operating principle of ink-jet printing can be summarized as follows: ink droplets are generated first, then tiny ink droplets are guided to a preset position by a nozzle, the smaller the droplet, the more precise the position of dropping, and the higher the printing resolution. Ink-jet printing has very high requirements on ink jetting amount and precision of ink jetting position, so an ink-jet printhead is usually formed by many tiny micro-nozzles, and generally each nozzle has a dropping amount of less than 100 picoliter (pL). During the process of ejecting ink, sporadic droplets might be sputtered beyond the preset positions for the droplets, which may be referred to as bad satellite, and the sputtered sporadic droplets may be referred to as satellite droplets. When the ink-jet printing process is implemented in the middle of the printing area of an object to be printed (i.e. a substrate), the sputtered satellite droplets may still drop on the printing area, but when the ink-jet printing process is implemented at edges of the printing area of an object to be printed, the sputtered satellite droplets may drop on areas outside of the printing area of the object to be printed. The satellite droplets on areas outside of the printing area will have bad effects on subsequent manufacturing processes, for example, causing inorganic sedimentary fault in the subsequent chemical vapor deposition process, causing laminated bubbles in the subsequent membrane pasting process, etc., which will influence the final product quality.

In summary, in the manufacturing process for flat panel display, when printing the object to be printed by means of the ink-jet printing technology, satellite droplets dropping on areas outside of the printing area will have undesirable effects on subsequent manufacturing processes and thus influencing the final product quality.

SUMMARY

Embodiments of the disclosure provide an ink-jet printhead, an ink-jet printing device and a display manufacturing device for eliminating or reducing droplets on areas outside of the printing area in the ink-jet printing process, thereby improving product quality.

An ink-jet printhead provided by an embodiment of the disclosure comprises at least one nozzle and a droplet removing component disposed in at least one edge area around the area where the at least one nozzle is located, the droplet removing component being used for removing droplets at a position corresponding to the edge area where the droplet removing component is located on an object to be printed.

By disposing a droplet removing component in at least one edge area around the area where the at least one nozzle is located, and using the droplet removing component to remove droplets at positions corresponding to the edge area where the droplet removing component is located on the object to be printed, the ink-jet printhead provided in the embodiment of the disclosure can eliminate droplets on areas outside of the printing area in the ink-jet printing process, thereby improving product quality.

In some embodiments, the ink-jet printhead may include a plurality of nozzles, and the area where the plurality of nozzles are located may be a rectangular area.

In some embodiments, a droplet removing component may be disposed at each of four edge areas around the area where the plurality of nozzles are located.

In some embodiments, the droplet removing component may include one of a vacuum adsorption element and an electrostatic adsorption element. In the embodiment of the disclosure, the vacuum adsorption element may be any appropriate mechanical element that can draw droplets away, which includes, but is not limited to, a vacuum adsorption pad or a vacuum adsorption plate having micropores on the surface thereof. The electrostatic adsorption element may be an element that can form an electrostatic field with the object to be printed, which includes, but is not limited to, a metal pad, a metal rod, a metal bar, etc.

Another embodiment of the present disclosure provides an ink-jet printing device, which may include the ink-jet printhead provided in any one of the above-described embodiments.

The ink-jet printing device provided in the embodiment of the present disclosure includes the above-mentioned ink-jet printhead, while the ink-jet printhead may eliminate droplets on areas outside of the printing area in the ink-jet printing process by disposing the droplet removing component in at least one edge area around the area where the at least one nozzle is located, and using the droplet removing component to remove droplets at positions corresponding to the edge area where the droplet removing component is located on the object to be printed, thus product quality may be improved.

In some embodiments, the droplet removing component may be a vacuum adsorption element, and the ink-jet printing device may further include at least one vacuum pump, and the at least one vacuum pump is in one-to-one correspondence with the vacuum adsorption elements.

In some embodiments, when any of the vacuum adsorption elements needs to eliminate droplets at positions corresponding to the edge area where the vacuum adsorption element is located on the object to be printed, the corresponding vacuum pump vacuumizes the vacuum adsorption element through a vent on the vacuum adsorption element.

In some embodiments, the ink-jet printing device further includes a control unit for controlling on and off of each vacuum pump, when any of the vacuum adsorption elements needs to remove droplets at positions corresponding to the edge area where the vacuum adsorption element is located on the object to be printed, the control unit controls to turn on the vacuum pump corresponding to the vacuum adsorption element.

In some embodiments, the control unit controls to turn on the vacuum pump corresponding to the vacuum adsorption element of the ink-jet printhead which is located at an edge of a printing area on the object to be printed, and controls to turn off the vacuum pump corresponding to the vacuum adsorption element of the ink-jet printhead which is located inside the printing area of the object to be printed.

By means of the control unit, it is possible to only enable the vacuum adsorption elements at edges of the printing area to operate, while the vacuum adsorption elements inside the printing area do not operate so as to save cost.

In some embodiments, the droplet removing component may be a vacuum adsorption element, and the ink-jet printing device further comprises one vacuum pump that is connected to at least one vacuum adsorption element.

In some embodiments, the vacuum pump may be connected to each of the vacuum adsorption elements.

In some embodiments, the ink-jet printing device may further comprise a control unit and at least one valve switch. The valve switch is in one-to-one correspondence with the vacuum adsorption elements and disposed on the corresponding vacuum adsorption elements. The control unit is used to control on and off of each valve switch and the vacuum pump. When any of the vacuum adsorption elements needs to remove droplets at positions corresponding to the edge area where the vacuum adsorption element is located on the object to be printed, the control unit controls to turn on the valve switch corresponding to the vacuum adsorption element and the vacuum pump, so that the vacuum pump can vacuumize the vacuum adsorption element through the valve switch.

In some embodiments, the control unit controls to turn on the valve switch corresponding to the vacuum adsorption element of the ink-jet printhead which is located at an edge of a printing area of the object to be printed, and controls to turn off the valve switch corresponding to the vacuum adsorption element of the ink-jet printhead which is located inside the printing area of the object to be printed.

By means of the control unit, it is possible to only enable the vacuum adsorption elements at edges of the printing area to operate, while the vacuum adsorption elements inside the printing area do not operate so as to save cost.

In some embodiments, the droplet removing component may be an electrostatic adsorption element, and the ink-jet printing device further includes a control unit, when any of the electrostatic adsorption elements needs to remove droplets at positions corresponding to the edge area where the electrostatic adsorption element is located on the object to be printed, the control unit controls electrical potentials of the electrostatic adsorption element and object to be printed, so that an electrostatic field is formed between the electrostatic adsorption element and the object to be printed, and the electrical potential of the electrostatic adsorption element has a polarity opposite to that of the charges on the droplets.

In some embodiments, the control unit may control the electrostatic adsorption element of the ink-jet printhead which is located at an edge of a printing area of the object to be printed to operate, and control the electrostatic adsorption element of the ink-jet printhead which is located inside the printing area of the object to be printed not to operate.

By means of the control unit, it is possible to only enable the electrostatic adsorption elements at edges of the printing area to operate, while the electrostatic adsorption elements inside the printing area do not operate, thus the operation cost may be saved.

A display manufacturing device provided in another embodiment of the present disclosure may include the ink-jet printing device provided in any of the above-described embodiments of this application.

The display manufacturing device provided in the embodiment of the disclosure employs the above-described ink-jet printing device, and the ink-jet printing device comprises the above-described ink-jet printhead, moreover, the ink-jet printhead can eliminate droplets on areas outside of the printing area in the ink-jet printing process by disposing a droplet removing component in at least one edge area around the area where the at least one nozzle is located, and using the droplet removing component to remove droplets at positions corresponding to the edge area where the droplet removing component is located on the object to be printed, thus quality of the final product can be improved.

DETAILED DESCRIPTION OF EMBODIMENTS

Embodiments of the present disclosure provide an ink-jet printhead, an ink-jet printing device and a display manufacturing device for eliminating droplets dropped on areas outside of the printing area in the ink-jet printing process, thereby improving product quality.

Technical solutions of embodiments of the disclosure will be described clearly and completely below in conjunction with figures for the embodiments, obviously, the described embodiments are merely some rather than all of the embodiments of the invention. All other embodiments obtained by those ordinarily skilled in the art on the basis of the embodiments in the disclosure shall fall within the scope of the application.

Figure 1:
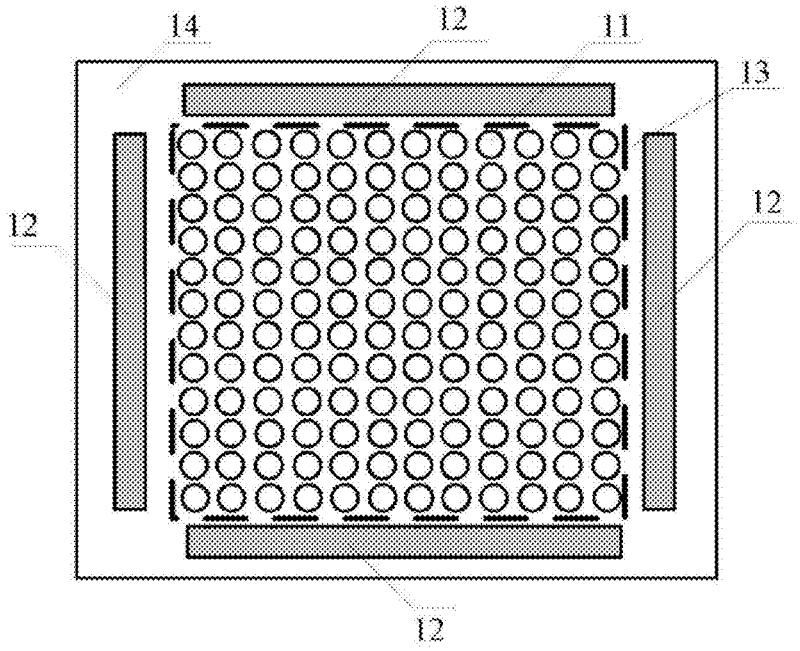
FIG. 1 is a schematic view of a planar structure of an ink-jet printhead provided in an embodiment of the present disclosure.

Referring to FIG. 1, which is a schematic view of a planar structure of an ink-jet printhead provided in an embodiment of the present disclosure. As can be seen from FIG. 1, the ink-jet printhead may include a plurality of nozzles 11 and four droplet removing components 12. The plurality of nozzles 11 are arranged in an array, and the four droplet removing components 12 are disposed at four edge areas 14 (i.e. areas outside of the block of dashed lines in FIG. 1) around a rectangular area 13 (i.e. area within the block of dashed lines in FIG. 1) where the plurality of nozzles 11 are located, and each of the four edge areas 14 has a droplet removing component 12 for eliminating droplets at positions corresponding to the edge area where the droplet removing component 12 is located on the object to be printed. For example, the droplet removing component 12 in the edge area 14 to the left of the rectangular area 13 can eliminate droplets at positions corresponding to the left edge area 14. The droplets may be satellite droplets generated by the nozzle 11 during printing, or some other droplets, such as droplets accidentally dropped in.

For this ink-jet printhead, by disposing a droplet removing component 12 at each of the four edge areas 14 around the rectangular area 13 where the plurality of nozzles 11 are located, and using the droplet removing components 12 to eliminate droplets at positions corresponding to the edge area where the droplet removing component 12 is located, droplets on areas outside of the printing area in the ink-jet printing process can be eliminated or reduced, thereby improving product quality.

In some embodiments, in the ink-jet printhead, droplet removing components may be disposed in one or more of the four edge areas around the rectangular area where the plurality of nozzles are located, and more than one droplet removing components may be disposed in each edge area. The embodiments of the present disclosure do not limit the number of area edges in which droplet removing components are disposed as well as the number of the droplet removing components.

In other embodiments, the plurality of nozzles of the ink-jet printhead may be arranged in other forms as needed, and the area where the plurality of nozzles are located may have other shapes, hence the embodiments of the present disclosure do not limit the arrangement of the nozzles as well as the shape of the area where the nozzles are located.

In addition, the ink-jet printhead provided in the embodiment of the present disclosure may include one or more nozzles, thus the embodiments of the present disclosure do not limit the number of nozzles.

In some embodiments, the droplet removing component 12 may be a vacuum adsorption element or an electrostatic adsorption element.

The volume and weight of the droplet might be only 1/1000 to 1/10000 of the volume and weight of a drop of ink normally printed by the nozzle. In case the droplet removing component 12 is a vacuum adsorption element, by controlling the level of the vacuum negative pressure, droplets can be removed without influencing the drops of ink normally printed by the nozzle. When the droplet removing component 12 is an electrostatic adsorption element, by controlling the intensity of the electrostatic field, droplets can be removed without influencing the drops of ink normally printed by the nozzle. With respect to large droplets, by properly adjusting the negative pressure of the vacuum adsorption element and the electric field of the electrostatic adsorption element, the droplets can still be removed.

Based on the same inventive concept, an embodiment of the present disclosure provides an ink-jet printing device, which may include the ink-jet printhead provided in any of the above-described embodiments.

The ink-jet printing device provided in the embodiment of the present disclosure includes the above ink-jet printhead, while the ink-jet printhead is provided with a droplet removing component in at least one edge area around the area where the at least one nozzle is located, for removing droplets at positions corresponding to the edge area where the droplet removing component is located, thus droplets on areas outside of the printing area during the ink-jet printing process can be eliminated and product quality can be improved.

In conjunction with the drawings, the ink-jet printing device provided in the embodiments of the disclosure will be described below by way of an example that the droplet removing component is a vacuum adsorption element or an electrostatic adsorption element.

Figure 2:
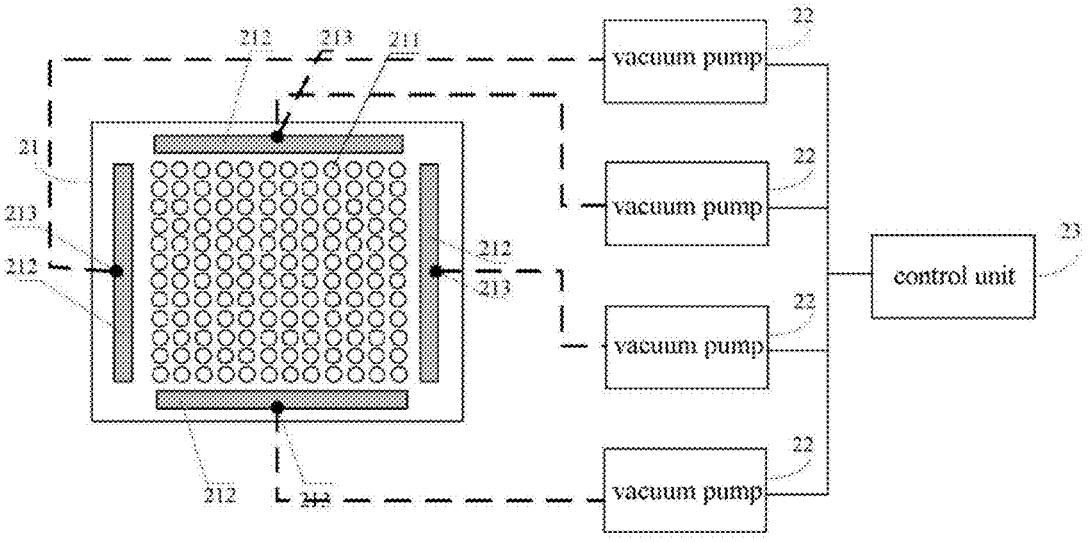
FIG. 2 is a schematic view of structure of an ink-jet printing device provided in an embodiment of the present disclosure.

Referring to FIG. 2, the ink-jet printing device provided in an embodiment of the disclosure may include an ink-jet printhead 21 as provided in the above embodiments, four vacuum pumps 22 and a control unit 23.

The ink-jet printhead 21 may include a plurality of nozzles 211, and a vacuum adsorption element 212 may be disposed in each of the four edge areas around a rectangular area where the plurality of nozzles 211 are located, the vacuum adsorption element 212 being used for eliminating droplets at positions corresponding to the edge area where the vacuum adsorption element 212 is located.

The vacuum pumps 22 may be in one-to-one correspondence with the vacuum adsorption elements 212. When any of the vacuum adsorption elements 212 needs to eliminate droplets at positions corresponding to the edge area where the vacuum adsorption element 212 is located, corresponding vacuum pump 22 will vacuumize the vacuum adsorption element 212 through a vent 213 (shown as a black dot in FIG. 2) provided on the vacuum adsorption element 212. The vacuum pump 22 may be connected to each vent 213 through a pipe (as shown by the dashed lines in FIG. 2).

The control unit 23 may control on and off of each vacuum pump 22. When any of the vacuum adsorption elements 212 needs to eliminate droplets at positions corresponding to the edge area where the vacuum adsorption element 212 is located, the control unit 23 controls to turn on the vacuum pump 22 corresponding to the vacuum adsorption element 212.

In some embodiments, the control unit 23 controls to turn on the vacuum pump 22 corresponding to the vacuum adsorption element 212 of the ink-jet printhead which is located at an edge of the printing area on the object to be printed, and controls to turn off the vacuum pump 22 corresponding to the vacuum adsorption element 212 of the ink-jet printhead which is located inside the printing area of the object to be printed. By means of this control unit 23, it is possible to only enable the vacuum adsorption elements 212 at edges of the printing area to operate, while the vacuum adsorption elements 212 inside the printing area do not operate, thus, the operation cost may be saved.

Figure 3:
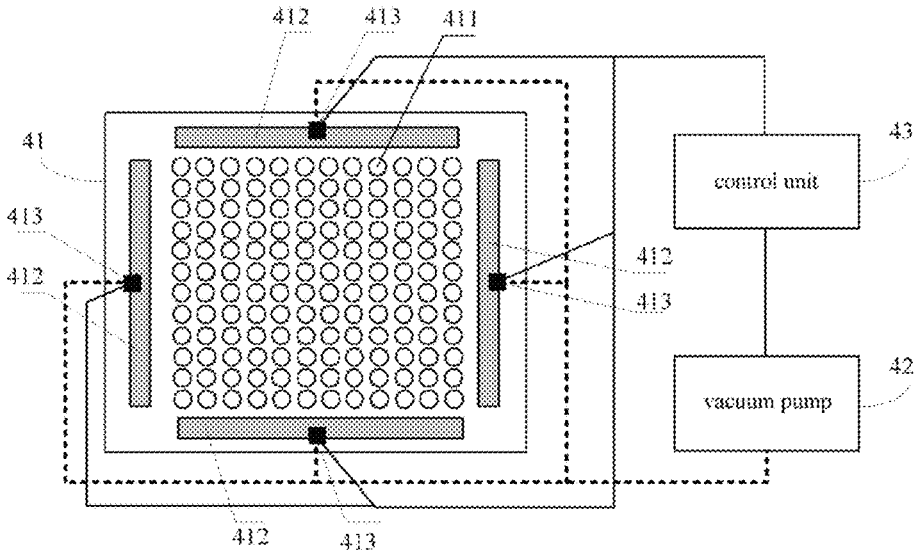
FIG. 3 is a schematic view of structure of an ink-jet printing device provided in another embodiment of the present disclosure.

Referring to FIG. 3, the ink-jet printing device provided in another embodiment of the present disclosure may include an ink-jet printhead 31 as provided in the above embodiment of the disclosure, a vacuum pump 42, a control unit 43 and at least one valve switch 413 (indicated by the black rectangle in FIG. 3).

The ink-jet printhead 41 may include a plurality of nozzles 411, and a vacuum adsorption element 412 may be disposed in each of the four edge areas around a rectangular area where the plurality of nozzles 411 are located, the vacuum adsorption element 412 being used for eliminating droplets at positions corresponding to the edge area where the vacuum adsorption element 412 is located.

The vacuum pump 42 is connected to each vacuum adsorption element 412. The valve switches 413 are in one-to-one correspondence with the vacuum adsorption elements 412 and disposed on the corresponding vacuum adsorption elements 412. The control unit 43 is used for controlling on and off of each valve switch 413 and each vacuum pump 42. When any of the vacuum adsorption elements 412 needs to eliminate droplets at positions corresponding to the edge area where the vacuum adsorption element 412 is located, the control unit 43 controls to turn on the valve switch 413 and vacuum pump 42 corresponding to the vacuum adsorption element 412, so that the vacuum pump 42 may vaccumize the vacuum adsorption element 412 through the valve switch 413. The vacuum pump 42 may be connected to the valve switch 413 through a pipe (as shown by the dashed lines in FIG. 3).

In some embodiments, the control unit 43 controls to turn on the valve switch 413 corresponding to the vacuum adsorption element 412 of the ink-jet printhead which is located at an edge of the printing area, and controls to turn off the valve switch 413 corresponding to the vacuum adsorption element 412 of the ink-jet printhead which is located inside the printing area. By means of the control unit 43, it is possible to only enable the vacuum adsorption elements 412 at edges of the printing area to operate, while the vacuum adsorption elements 412 inside the printing area do not operate so as to save cost.

In some embodiments, the valve switches may not be disposed on the vacuum adsorption elements, as long as the valve switches are corresponding to the vacuum adsorption elements in a one-to-one manner, and when any of the vacuum adsorption elements needs to eliminate droplets at positions corresponding to the edge area where the vacuum adsorption element is located, the vacuum pump can vacuumize the vacuum adsorption element through a valve switch corresponding to the vacuum adsorption element, hence the embodiments of the disclosure do not limit the positions of the valve switches.

It can be seen that the control unit 23 and control unit 43 in the above embodiments can both be used for controlling the vacuum adsorption elements of the ink-jet printhead which are located at edges of the printing area to operate, and controlling the vacuum adsorption elements of the ink-jet printhead which are located inside the printing area not to operate.

Figure 4:
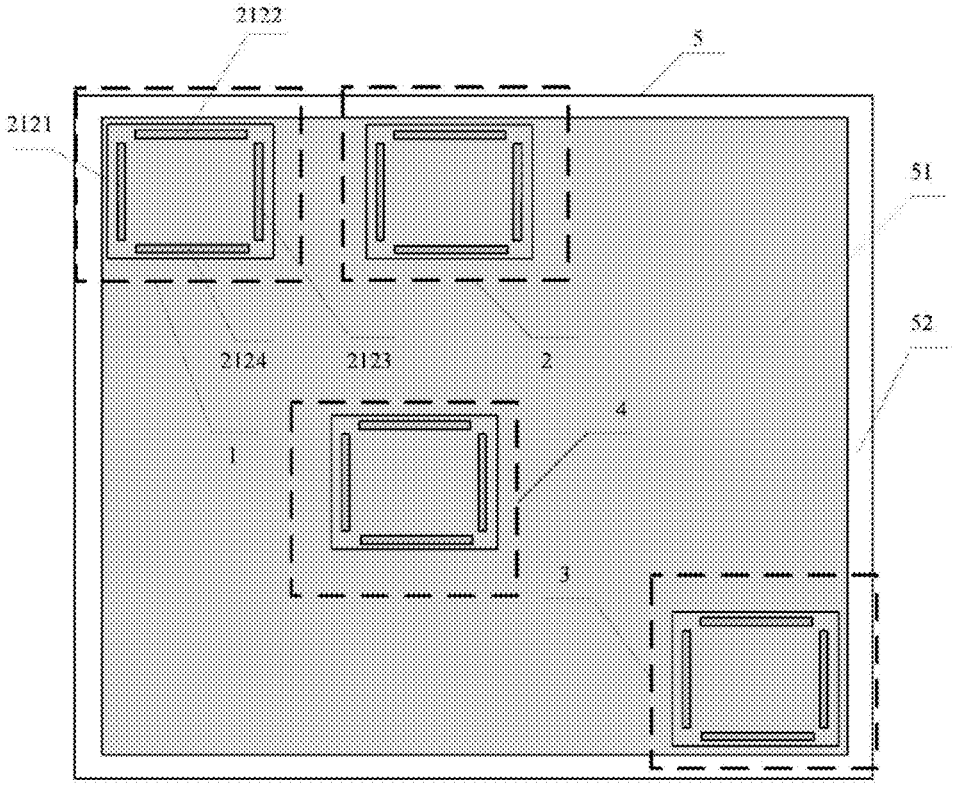
FIG. 4 is for illustrating printing on a substrate by means of the ink-jet printing device as shown in FIG. 2 or FIG. 3 according to an embodiment of the present disclosure.

FIG. 4 is a schematic view for showing the process of printing a substrate by means of the ink-jet printing device provided in the above embodiments of the disclosure. The dashed boxes in FIG. 4 represent printing positions. The left and upper portions of printing position 1 as shown in FIG. 4 are edges of a printing area 51 of substrate 5 (substrate 5 including the printing area 51 and a non-printing area 52), the upper portion of position 2 is the edge of the printing area 51 of substrate 5, the right and lower portions of position 3 are edges of the printing area 51 of substrate 5, and position 4 is the central area of the printing area 51 of substrate 5. The ink-jet printhead of the ink-jet printing device may carry out ink-jet printing on the entire substrate 5 by way of scanning. The ink-jet printhead may include a first vacuum adsorption element 2121, a second vacuum adsorption element 2122, a third vacuum adsorption element 2123, and a fourth vacuum adsorption element 2124. When it is needed to print on a portion of substrate 5 at position 1, the control unit (not shown in FIG. 4) controls the first vacuum adsorption element 2121 and the second vacuum adsorption element 2122 to operate, and the third vacuum adsorption element 2123 and the fourth vacuum adsorption element 2124 not to operate, so that the first vacuum adsorption element 2121 and the second vacuum adsorption element 2122 can eliminate droplets at positions corresponding to the edge areas where they are located. When it is needed to print on a portion of substrate 5 at position 2, the control unit controls the second vacuum adsorption element 2122 to operate, and the first vacuum adsorption element 2121, the third vacuum adsorption element 2123 and the fourth vacuum adsorption element 2124 not to operate, so that the second vacuum adsorption element 2122 can eliminate droplets at positions corresponding to the edge area where it is located. When it is needed to print on a portion of substrate 5 at position 3, the control unit controls the third vacuum adsorption element 2123 and the fourth vacuum adsorption element 2124 to operate, and the first vacuum adsorption element 2121 and the second vacuum adsorption element 2122 not to operate, so that the third vacuum adsorption element 2123 and the fourth vacuum adsorption element 2124 can eliminate droplets at positions corresponding to the edge areas where they are located. When it is needed to print on a portion of substrate 5 at position 4, the control unit controls the first vacuum adsorption element 2121, the second vacuum adsorption element 2122, the third vacuum adsorption element 2123 and the fourth vacuum adsorption element 2124 not to operate. By analogy, when it is needed to print on other positons of substrate 5, the control unit controls the vacuum adsorption element of the ink-jet printhead which is located at an edge of the printing area 51 to operate, and controls the vacuum adsorption element of the ink-jet printhead which is inside the printing area 51 not to operate, in this way, there will not be any droplet on area 52 (i.e. non-printing area 52) outside the printing area 51 of the substrate 5, or the droplets will be significantly reduced, thereby improving product quality. By means of the control unit, it is possible to only enable the vacuum adsorption elements at edges of the printing area 51 to operate, while the vacuum adsorption elements inside the printing area 51 do not operate, thus the cost can be saved.

In some embodiments, in case the droplet removing component is a vacuum adsorption element, the ink-jet printing device may be implemented in other ways, for example, by combining the embodiment shown in FIG. 2 with the embodiment shown in FIG. 3, so that the ink-jet printing device may include one or more vacuum pumps, each being connected to one or more vacuum adsorption elements.

Figure 5:
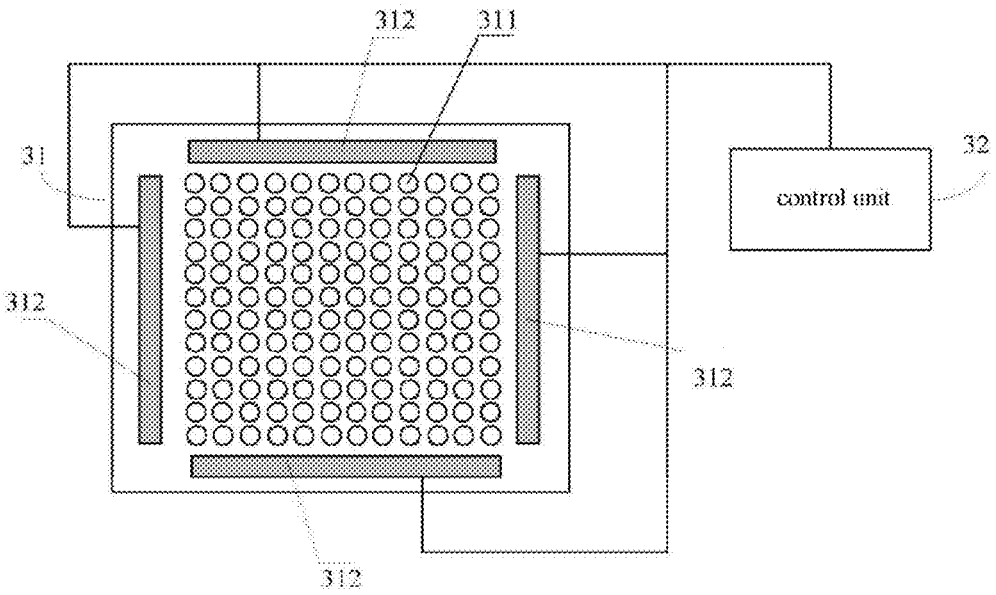
FIG. 5 is a schematic view of structure of an ink-jet printing device provided in another embodiment of the present disclosure.

Referring to FIG. 5, the ink-jet printing device provided in another embodiment of the disclosure may include an ink-jet printhead 31 and control unit 3.

The ink-jet printhead 31 may include a plurality of nozzles 311, and an electrostatic adsorption element 312 may be disposed at each of the four edge areas around the rectangular area where the plurality of nozzles 311 are located, the electrostatic adsorption element 312 being used to eliminate droplets at positions corresponding to the edge area where the electrostatic adsorption element 312 is located.

With respect to any of the electrostatic adsorption elements 312, when the electrostatic adsorption element 312 needs to remove droplets at positions corresponding to the edge area where the electrostatic adsorption element 312 is located, the control unit 32 may control electrical potentials of the electrostatic adsorption element 312 and the object to be printed (e.g. substrate), so that an electrostatic field is formed between the electrostatic adsorption element 312 and the object to be printed, and electrical potential of the electrostatic adsorption element 312 has a polarity opposite to that of the charges on the droplets. For example, if the droplets are negatively charged, the control unit 32 controls the potential of the electrostatic adsorption element 312 to be a high potential and the potential of the substrate to be a low potential, thus an electrostatic field will be formed between the electrostatic adsorption element 312 and the substrate, and according to the principle that opposite charges attract, the negatively charged droplets will be adsorbed by the electrostatic adsorption element 312.

In some embodiments, the control unit 32 may control the electrostatic adsorption element 312 of the ink-jet printhead 31 which is located at an edge of the printing area to operate, and may control the electrostatic adsorption element 312 of the ink-jet printhead 31 which is located inside the printing area not to operate. By means of the control unit 32, it is possible to only enable the electrostatic adsorption elements 312 at edges of the printing area to operate, while the electrostatic adsorption elements inside the printing area do not operate so as to save cost.

Figure 6:
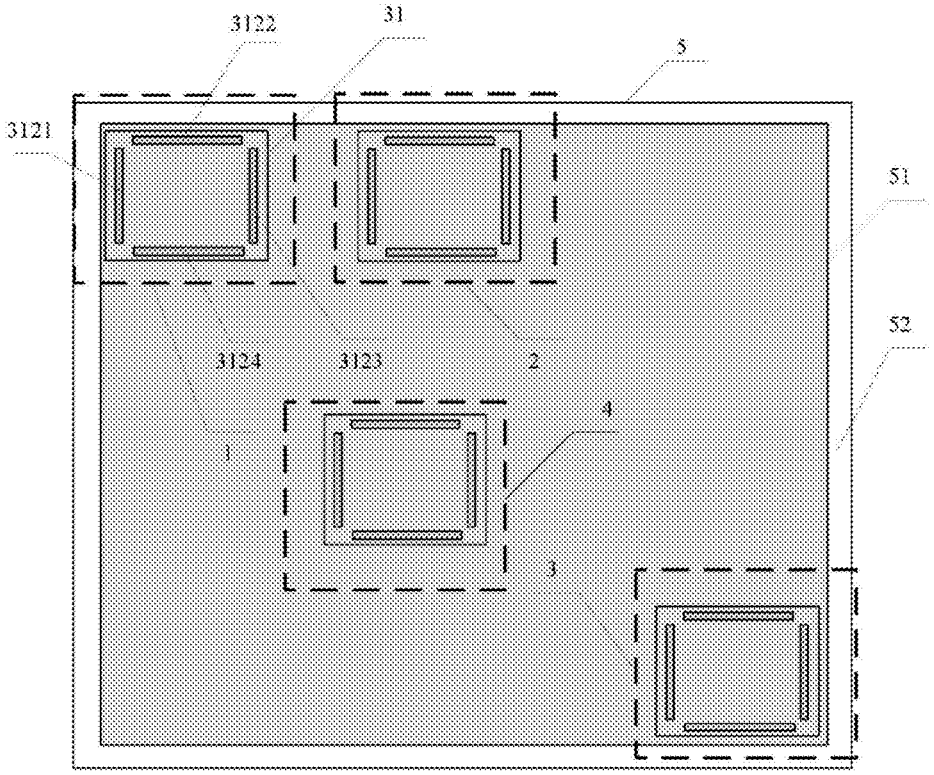
FIG. 6 is for illustrating printing on a substrate by means of the ink-jet printing device as shown in FIG. 5 according to an embodiment of the present disclosure.

FIG. 6 is a schematic view for showing printing on a substrate using the ink-jet printing device provided by another embodiment of the present disclosure. The dashed boxes in FIG. 6 represent printing positions. The left and upper portions of position 1 are edges of the printing area 51 of substrate 5, the upper portion of position 2 is the edge of the printing area 51 of substrate 5, the right and lower portions of position 3 are edges of the printing area 51 of substrate 5, and position 4 is the central area of the printing area 51 of substrate 5. The ink-jet printhead 31 of the ink-jet printing device may carry out ink-jet printing on the entire substrate 5 by way of scanning. The ink-jet printhead 31 may include a first electrostatic adsorption element 3121, a second electrostatic adsorption element 3122, a third electrostatic adsorption element 3123, and a fourth electrostatic adsorption element 3124. When it is needed to print on a portion of substrate 5 at position 1, the control unit (not shown in FIG. 6) controls the first electrostatic adsorption element 3121 and the second electrostatic adsorption element 3122 to operate, and the third electrostatic adsorption element 3123 and the fourth electrostatic adsorption element 3124 not to operate, so that the first electrostatic adsorption element 3121 and the second electrostatic adsorption element 3122 can eliminate droplets at positions corresponding to the edge areas where they are located. When it is needed to print on a portion of substrate 5 at position 2, the control unit controls the second electrostatic adsorption element 3122 to operate, and the first electrostatic adsorption element 3121, the third electrostatic adsorption element 3123 and the fourth electrostatic adsorption element 3124 not to operate, so that the second electrostatic adsorption element 3122 can eliminate droplets at positions corresponding to the edge area where it is located. When it is needed to print on a portion of substrate 5 at position 3, the control unit controls the third electrostatic adsorption element 3123 and the fourth electrostatic adsorption element 3124 to operate, and the first electrostatic adsorption element 3121 and the second electrostatic adsorption element 3122 not to operate, so that the third electrostatic adsorption element 3123 and the fourth electrostatic adsorption element 3124 can eliminate droplets at positions corresponding to the edge areas where they are located. When it is needed to print on a portion of substrate 5 at position 4, the control unit controls the first electrostatic adsorption element 3121, the second electrostatic adsorption element 3122, the third electrostatic adsorption element 3123 and the fourth electrostatic adsorption element 3124 not to operate. By analogy, when it is needed to print on other positons of substrate 5, the control unit controls the electrostatic adsorption element of the ink-jet printhead 31 which is located at an edge of the printing area 51 to operate, and controls the electrostatic adsorption element of the ink-jet printhead 31 which is inside the printing area 51 not to operate, so that there will not be any droplet in area 52 outside the printing area 51 of the substrate 5, or the droplets will be significantly reduced, thereby improving product quality. By means of the control unit, it is possible to only enable the electrostatic adsorption elements at edges of the printing area 51 to operate, while the electrostatic adsorption elements inside the printing area 51 do not operate so as to save cost.

Based on the same inventive concept, another embodiment of the disclosure provides a display manufacturing device, which may include the ink-jet printing device provided in any one of the above-described embodiments of the disclosure.

The display manufacturing device includes the ink-jet printing device provided in the above embodiment, and the ink-jet printing device includes the ink-jet printhead provided in the above embodiment, while the ink-jet printhead can eliminate droplets on areas outside of the printing area during the ink-jet printing process by having a droplet removing component in at least one edge area around the area where the nozzles are located for removing droplets at positions corresponding to the edge area where the droplet removing component is located, thus product quality may be improved.

In summary, embodiments of the disclosure provide an ink-jet printhead, an ink-jet printing device and a display manufacturing device. By disposing a droplet removing component in at least one edge area around the area where at least one nozzle is located, and using the droplet removing component to remove droplets at positions corresponding to the edge area where the droplet removing component is located, droplets can be eliminated on areas outside of the printing area in the ink-jet printing process, thereby improving product quality.

Although exemplary embodiments of the invention have been described, those skilled in the art can make changes and modifications to the embodiments based on the concept disclosed herein, so the appended claims shall be construed as including the exemplary embodiments and all changes and modifications that fall within the scope of concept disclosed herein.

In other words, those skilled in the art can make various changes and modifications to the embodiments disclosed herein without departing from the spirit and scope of the invention. Thus if such modifications and changes fall into the scope of the claims of this application and their equivalents, then the application intends to encompass such changes and modifications.

The invention claimed is:

1. An ink-jet printhead comprising:

a plurality of nozzles, the plurality of nozzles being arranged in an array so that jet holes of the nozzles together form a rectangular jet surface, and a droplet removing component disposed in at least one edge area around the rectangular jet surface, the droplet removing component being used for removing droplets at a position on an object to be printed corresponding to the edge area where the droplet removing component is located, wherein the rectangular jet surface is free of droplet removing component.

2. The ink-jet printhead according to claim 1, wherein a droplet removing component is disposed at each of four edge areas around the area where the plurality of nozzles are located.

3. The ink-jet printhead according to claim 1, wherein the droplet removing component includes one of a vacuum adsorption element and an electrostatic adsorption element.

4. An ink-jet printing device comprising an ink-jet printhead, the ink-jet printhead comprising:

a plurality of nozzles, the plurality of nozzles being arranged in an array so that jet holes of the nozzles together form a rectangular jet surface, and a droplet removing component disposed in at least one edge area around the rectangular jet surface, the droplet removing component being used for removing droplets at a position on an object to be printed corresponding to the edge area where the droplet removing component is located, wherein the rectangular jet surface is free of droplet removing component.

5. The ink-jet printing device according to claim 4, wherein the droplet removing component is a vacuum adsorption element, and the ink-jet printing device further comprises at least one vacuum pump, and the at least one vacuum pump is in one-to-one correspondence with the vacuum adsorption element.

6. The ink-jet printing device according to claim 5, wherein when any of the vacuum adsorption elements needs to eliminate droplets at positions corresponding to the edge area where the vacuum adsorption element is located on the object to be printed, the corresponding vacuum pump vacuumizes the vacuum adsorption element through a vent on the vacuum adsorption element.

7. The ink-jet printing device according to claim 6, wherein the ink-jet printing device further includes a control unit for controlling on and off of each vacuum pump, when any of the vacuum adsorption elements needs to remove droplets at positions corresponding to the edge area where the vacuum adsorption element is located on the object to be printed, the control unit controls to turn on the vacuum pump corresponding to the vacuum adsorption element.

8. The ink-jet printing device according to claim 7, wherein the control unit controls to turn on the vacuum pump corresponding to the vacuum adsorption element of the ink-jet printhead which is located at an edge of a printing area on the object to be printed, and controls to turn off the vacuum pump corresponding to the vacuum adsorption element of the ink-jet printhead which is located inside the printing area of the object to be printed.

9. The ink-jet printing device according to claim 4, wherein the droplet removing component is a vacuum adsorption element, and the ink-jet printing device further comprises one vacuum pump that is connected to at least one vacuum adsorption element.

10. The ink-jet printing device according to claim 9, wherein the vacuum pump is connected to each of the vacuum adsorption elements.

11. The ink-jet printing device according to claim 10, wherein the ink-jet printing device further comprises a control unit and at least one valve switch; wherein the valve switch is in one-to-one correspondence with the vacuum adsorption element and disposed on the corresponding vacuum adsorption element; wherein the control unit is used to control on and off of each valve switch and the vacuum pump; wherein when any of the vacuum adsorption elements needs to remove droplets at positions corresponding to the edge area where the vacuum adsorption element is located on the object to be printed, the control unit controls to turn on the valve switch corresponding to the vacuum adsorption element and the vacuum pump, so that the vacuum pump vacuumizes the vacuum adsorption element through the valve switch.

12. The ink-jet printing device according to claim 11, wherein the control unit controls to turn on the valve switch corresponding to the vacuum adsorption element of the ink-jet printhead which is located at an edge of a printing area of the object to be printed, and controls to turn off the valve switch corresponding to the vacuum adsorption element of the ink-jet printhead which is located inside the printing area of the object to be printed.

13. The ink-jet printing device according to claim 4, wherein the droplet removing component is an electrostatic adsorption element, and the ink-jet printing device further includes a control unit, when any of the electrostatic adsorption elements needs to remove droplets at positions corresponding to the edge area where the electrostatic adsorption element is located on the object to be printed, the control unit controls electrical potentials of the electrostatic adsorption element and object to be printed, so that an electrostatic field is formed between the electrostatic adsorption element and the object to be printed, and the electrical potential of the electrostatic adsorption element has a polarity opposite to that of the charges on the droplets.

14. The ink-jet printing device according to claim 13, wherein the control unit controls the electrostatic adsorption element of the ink-jet printhead which is located at an edge of a printing area of the object to be printed to operate, and controls the electrostatic adsorption element of the ink-jet printhead which is located inside the printing area of the object to be printed not to operate.

15. The ink-jet printing device according to claim 4, wherein a droplet removing component is disposed at each of four edge areas around the area where the plurality of nozzles are located.

16. The ink-jet printing device according to claim 4, wherein the droplet removing component includes one of a vacuum adsorption element and an electrostatic adsorption element.

17. A display manufacturing device comprising an ink-jet printing device, the ink-jet printing device comprising an ink-jet printhead, the ink-jet printhead comprising:

a plurality of nozzles, the plurality of nozzles being arranged in an array so that jet holes of the nozzles together form a rectangular jet surface, and a droplet removing component disposed in at least one edge area around the rectangular jet surface, the droplet removing component being used for removing droplets at a position on an object to be printed corresponding to the edge area where the droplet removing component is located, wherein the rectangular jet surface is free of droplet removing component.

18. The display manufacturing device according to claim 17, wherein the droplet removing component includes one of a vacuum adsorption element and an electrostatic adsorption element.

* * * * *